US007517168B1

(12) United States Patent
Fredlund et al.

(10) Patent No.: US 7,517,168 B1
(45) Date of Patent: Apr. 14, 2009

(54) SYSTEM FOR DISPLAYING, STORING AND RETRIEVING IMAGES

(75) Inventors: John R. Fredlund, Rochester, NY (US); Joseph A. Manico, Rochester, NY (US); Richard G. Mackson, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/213,169

(22) Filed: Dec. 17, 1998

(51) Int. Cl.
*B42D 15/00* (2006.01)
*B42F 13/00* (2006.01)

(52) U.S. Cl. ..... 402/79; 281/38; 283/74

(58) Field of Classification Search ..... 402/79, 402/70, 73, 75; 281/38, 21.1, 15.1, 22, 29; 283/74, 75, 900, 36–42; 40/158, 61, 158 R, 40/361, 701, 768; 83/36–42
See application file for complete search history.

(56) References Cited

U.S. PATENT DOCUMENTS

| | | | | |
|---|---|---|---|---|
| 2,747,865 | A | | 5/1956 | Marshall, Jr. |
| 3,670,434 | A | | 6/1972 | Shibata et al. |
| 3,797,152 | A | | 3/1974 | Brandt |
| 4,023,292 | A | | 5/1977 | Shibata et al. |
| 4,048,740 | A | | 9/1977 | Zitzelberger et al. |
| 4,720,733 | A | | 1/1988 | Ohtake et al. |
| 4,903,068 | A | * | 2/1990 | Shiota ..... 355/20 |
| 4,965,948 | A | * | 10/1990 | Ruebens ..... 40/537 |
| 5,301,803 | A | * | 4/1994 | Hansen et al. ..... 206/232 |
| 5,620,271 | A | * | 4/1997 | Bergh et al. ..... 402/79 |
| 5,709,496 | A | * | 1/1998 | Werner et al. ..... 402/79 |
| 5,765,875 | A | * | 6/1998 | Rowley ..... 283/74 |
| 5,782,349 | A | * | 7/1998 | Combs ..... 206/308.1 |
| 5,791,692 | A | * | 8/1998 | Manico et al. ..... 283/67 |
| 5,823,573 | A | * | 10/1998 | Chang ..... 281/38 |

FOREIGN PATENT DOCUMENTS

| | | |
|---|---|---|
| GB | 1184884 | 3/1970 |
| GB | 1506695 | 4/1978 |

* cited by examiner

*Primary Examiner*—Willmon Fridie
(74) *Attorney, Agent, or Firm*—Frank Pincelli

(57) ABSTRACT

An improved album leaf and system for displaying, storing and retrieving images. The album leaf comprises a first side and a second side, the first side having a plurality of images formed thereon, and an icon for identifying the images on the first side and the source from which the images originated. A binder may include a plurality of the album leaves having a plurality of retaining means, for example, pockets for holding items containing the original source from which the images displayed in the album leaf originated. A separate source retaining leaf may be provided having holding means for retaining the original source from which the images displayed on the album leaf originated.

55 Claims, 5 Drawing Sheets

SYSTEM FOR DISPLAYING, STORING AND RETRIEVING IMAGES

FIELD OF THE INVENTION

The present invention is directed to the field of storing and displaying print images, for identifying the source from which the images originated, and for storing the source of the original image.

BACKGROUND OF THE INVENTION

Typically, consumers receive individual photographic prints from photofinishers and the film negative from which the prints were made. The film negatives may be provided in cut strips loosely with the prints, or may be provided in a film cassette having a cartridge ID if the prints were obtained from APS film (Advanced Photographic System, recently introduced). The loosely provided prints tend to make it difficult for the owners to store or view the prints. When prints provided from APS film are returned to the customer, index prints are also provided. The index print allows the identifying and locating of particular images returned in the APS film cartridge. This, of course, provides an added print at added cost to the photofinisher.

In U.S. Ser. No. 08/455,770, filed May 31, 1995, entitled "Dual Sides Photographic Album Leaf and Method of Making," there is disclosed providing to the customer one or more album leaves containing the images on the roll of film. These leaves may be used to provide all of the service prints present on the negative filmstrip. However, it is difficult to relate the images on the album page to the individual negatives from the roll of film from which it originated. The customer must first sort through the separate index prints returned to the customer, which may not be conveniently located.

Applicants have invented an improved album page and system for displaying, storing and retrieving of images which overcomes many of the storing, displaying and retrieving problems of the prior art.

SUMMARY OF THE INVENTION

The present invention is directed to overcoming one or more of the problems set forth above. According to one aspect of the present invention, there is provided an album leaf having a first side having a first image retaining section and a second side having a second image retaining section, the first image retaining section on the first side having a plurality of images, and a first icon formed thereon, the first icon individually identifying the source from which the plurality of images originated.

In accordance with another aspect of the present invention there is provided a system for displaying, storing and retrieving images, comprising:

an album leaf having a first side having a first image retaining section and a second side having a second image retaining section, the first image retaining section on the first side having a plurality of images, and a first icon formed thereon, the first icon individually identifying the source from which each of the plurality of images originated; and a binder for containing a plurality of the album leaves, the album having a plurality of retaining means for holding items containing the original source of the images contained in the album leaf.

In accordance with another aspect of the present invention there is provided a system for displaying, storing and retrieving images, comprising:

an album leaf having a first side and a second side, the first side having a plurality of images and an icon formed thereon, the icon for individually identifying the first source from which the at least each of the plurality of images originated;

a binder for containing a plurality of the album leaves; and a retaining album leaf having a plurality of retaining means for holding items containing the original source of the images contained in the album leaf.

In accordance with yet another aspect of the present invention there is provided a source retaining album leaf for placement in a binder having at least one album leaf placed therein, the album leaf having a first side having a first image retaining section and a second side having a second image retaining section, the first image retaining section on the first side having a plurality of images and a first icon formed thereon, the first icon individually identifying the first source from which each of the plurality of images on the first side originated, the source retaining album leaf having a plurality of retaining means for holding items containing the original source of the images contained in the album leaf.

In another aspect of the present invention there is provided an image-bearing media having a first side having a first image retaining section the first image retaining section of the first side having a plurality of images and a fist icon formed thereon, said first icon individually identifying the source from which each of the plurality of images originated.

In still another aspect of the present invention there is provided a system for displaying, storing and retrieving images, comprising:

an image-bearing media having a first side having a first image retaining section and a second side having a second image retaining section, the image retaining section on the first side having a plurality of images formed on the first side originating from a first source and an icon also formed on the first side for individually identifying the source from which each of the plurality of images originated; and a binder for containing the album leaf, the album having a plurality of retaining means for holding items containing the first source of the images contained in the album leaf.

The above, and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
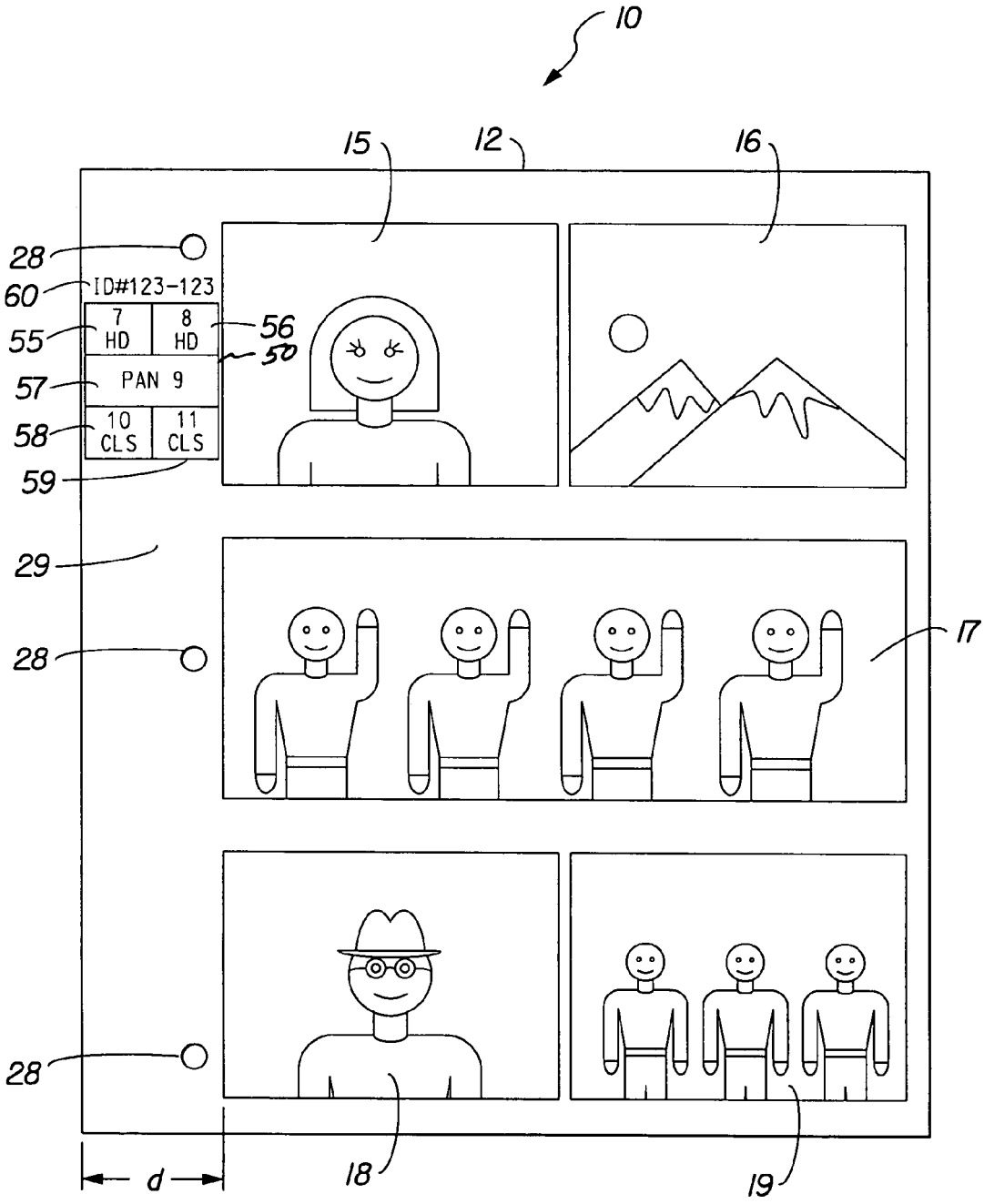
FIG 1 is a front elevational view of an album leaf made in accordance with the present invention.

The present description will be directed in particular to elements forming part of, or in cooperation more directly with, the apparatus in accordance with the present invention. It is understood that elements not specifically shown or described may take various forms well known to those skilled in the art.

Referring to FIGS. 1-4, there is illustrated an album leaf 10 made in accordance with the present invention. The leaf 10 includes a first side 12 and a second side 14. The first side 12 includes a plurality of images 15,16,17,18,19 and the second side includes a plurality of images 21,22,23,23,25. Also provided in the preferred embodiment is a plurality of holes 28 in a margin area 29, which can be used for mounting of the leaf in an album. The width d of margin area 29 may be of any desired size. In the particular embodiment illustrated, the width d is about one inch (2.54 cm).

Figure 2:
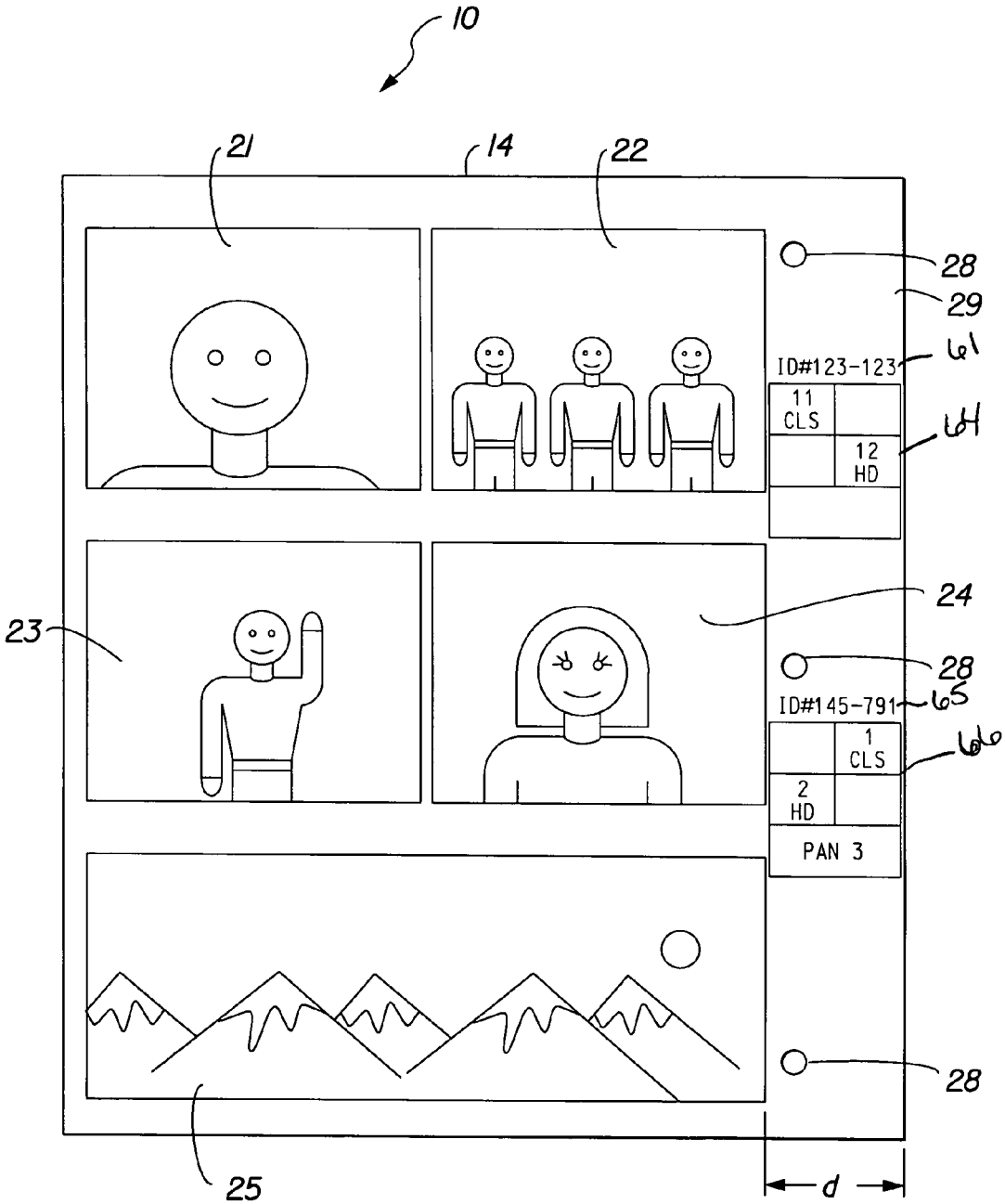
FIG. 2 is a back elevational view of the album leaf of FIG. 1.

As can be seen by FIGS. 1 and 2, the various size images are composed so as to substantially fill the space on each side 12,14. Also, as illustrated, various combinations and sizes of prints may be placed together. For example, as illustrated in FIG. 1, the images 15,16,18,19 are similar in size and whereas image 17 is of a substantially different size format, such as the C, H, and P formats of the Advanced Photo System. It is to be understood that any desired size images and/or number of images may be provided on either of sides 12,14. The images have been either automatically composed by the printing device, or printed in accordance with customer instructions. This can be done by optical printers such as the Kodak S-Series Printer, which prints multiple images on a single web of photosensitive paper. Alternatively, digital printers, such as the Kodak PCD 600 CRT Printer and the Kodak HLT-7720 Continuous Tone Digital Printer, can be used which allows for free form formatting of the images. It is, of course, understood that other type printers, such as laser, thermal, ink jet, or electrophotographic printers, may be used as desired. In the embodiment illustrated, images 15,16,18,19 each have a size of about 3-½ inches×4-⅞ inches, and image 17 is equivalent to a panoramic-type image, which have a size of approximately 3-½ inches×9-¾ inches. Likewise, on the second side 14, images 21,22,23,24 are substantially equal size, whereas image 25 is of a substantially greater size.

Figure 3:
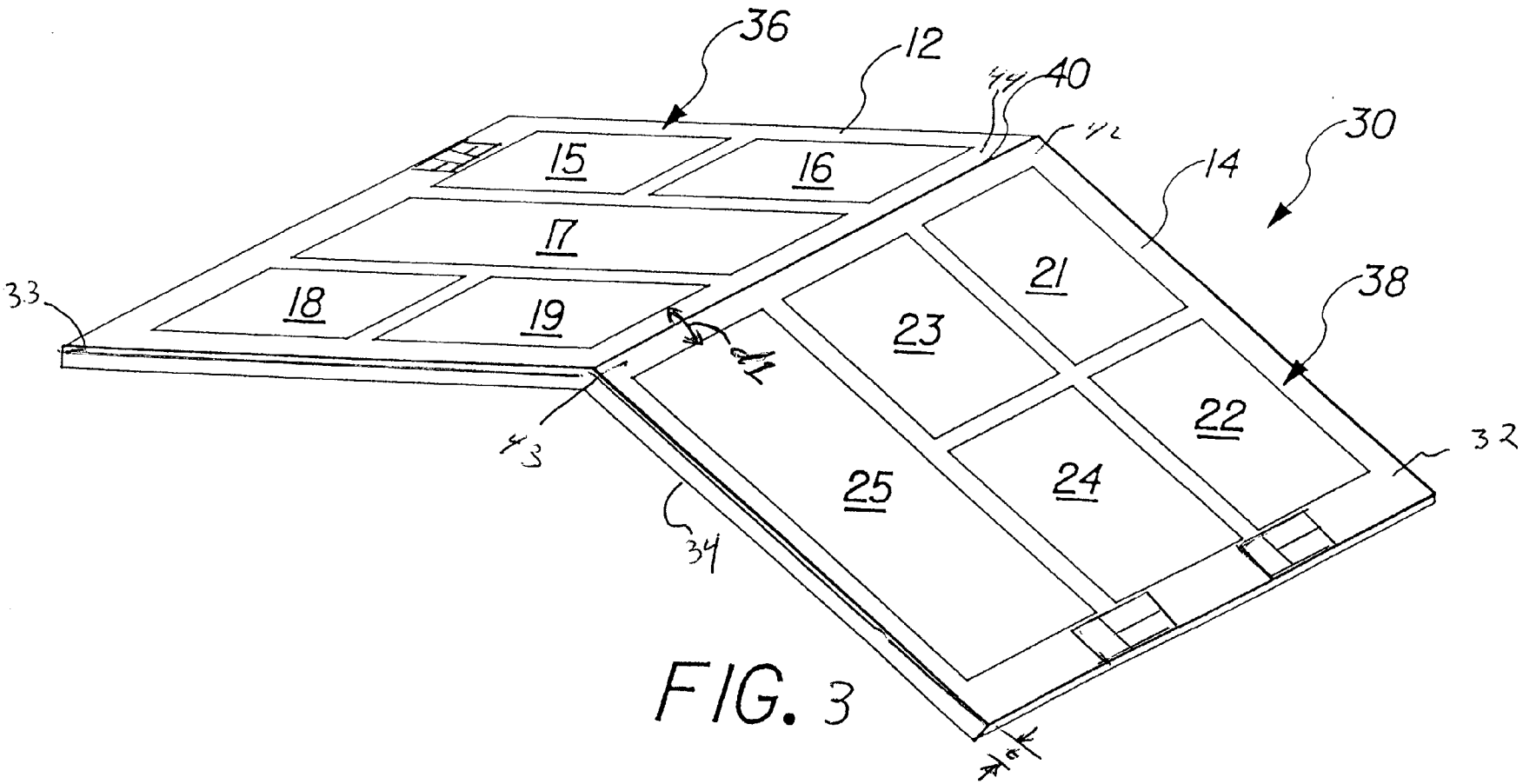
FIG. 3 is a perspective view of a sheet of photographic material illustrating how the album leaf of FIGS. 1 and 2 may be formed.

Referring to FIG. 3, there is illustrated a sheet 30 made of an image-bearing media. In the embodiment illustrated, sheet 30 is a photosensitive material. In particular, the photosensitive material is photographic paper, which has an image forming side 32 and a backside 34. As is typical with photosensitive material, the image forming side 32 includes an emulsion layer 33 upon which an image can be formed. The backside of the material merely provides the supporting substrate for holding of the emulsion layer. The sheet 30 has a thickness t. The thickness t may be any thickness desired. Preferably, the thickness t is minimal so that the album page will not be too thick, yet provide the desired rigidity. Generally the thickness t will be in the range of 0.05 mm to 0.5 mm. In the particular embodiment illustrated, the thickness t is approximately 0.2 mm.

As illustrated in FIG. 3, images 15,16,17,18,19,21,22,23,24,25 have been formed on the image forming side 32 of sheet 30 by an appropriate printer, such as previously described. The images 15,16,17,18,19 have been composed into a first image retaining section 36, whereas images 21,22,23,23,25 have been composed onto a second image retaining section 38. These image retaining sections 36,38 may be sized and configured as desired. Preferably, the image retaining sections 36,38 are designed so as to correspond to the first and second sides 12,14 of leaf 10, respectively. In the preferred embodiment illustrated, a space 43 having a width d1 is provided between first and second image retaining sections 36,38. Also, as preferably illustrated, a fold line 40 about which the sheet 30 is folded is provided in space 43. The width d1 may be any desired size. In the embodiment illustrated, width d1 is about 1.0 inches (2.54 cm). The fold line 40 is preferably located such that the first image section 36 and second image section 38 are substantially co-extensive with each other. As illustrated, lateral edge portions 42,44 are disposed adjacent first and second image sections 36,38, respectively, and placed adjacent each other so as to form the margin area 29 when sheet 30 is folded.

The images sent to the digital printer may be obtained by any desired manner. In the preferred embodiment of the present invention, a digital printer such as the Kodak PCD-600 CRT Printer, is used so that free form formatting can be easily obtained in accordance with instructions provided by the consumer. The digital data information is representative of the images and can be obtained by scanning original images, either in the form of prints or negatives as is customarily done in the prior art. However, the digital data information may not be limited to images. The digital data information may also contain other information such as text, or the logos, images, etc., which can be added to the scanned data. Also the digital data may be obtained in any desired manner, for example, by computers or other devices which contains digital files such as CDs or from data contained in the magnetics on film. A digital record is formed from the scanned information and any other digital information provided. This digital record is then composed into first and second digital sub-records. The first and second digital sub-records are used to print images in the first and second image retaining sections 36,38, which will correspond to the sides 12,14 of the leaf 10. It is, of course, understood that the images may be composed in any desired manner. Additionally, any text or other information provided, or manipulation of the data, may be conducted as desired. For example, but not by way of limitation, text, logos, or other images, could be added to the scanned images. Once the appropriate digital records have been formed, printing by the printer can then be performed whereby the images and other text/images present in the digital records are appropriately printed on the photosensitive material. The developed photosensitive material is then taken from the printer where thereafter it is formed into the leaf 10.

Developed photographic material is folded in a manner such that the backsides are brought back against each other and an appropriate adhesive is applied therebetween for securely holding the folded sections together. It is to be understood that the formation of the album leaf may take place in any appropriate manner. U.S. Ser. No. 08/455,770, filed May 31, 1995, entitled "Dual Sides Photographic Album Leaf and Method of Making," provides further details by which the leaf may be formed and which hereby is incorporated by reference in its entirety.

As illustrated in FIGS. 1 and 2, icons (reference indicia) 50,52,54 are provided for identifying each of the images (15-25) and the source from which the images originate. In particular, referring to icon 50, it comprises a plurality of silhouettes (an outline representation of the edges) of the actual images 15,16,17,18,19 provided on the first side 12. Additionally, the icons may be composed of thumbnail (miniature) image representations of the actual images. In particular, there are provided silhouettes 55,56,57,58,59, each of which refer to the location of its respective images 15,16,17,18,19. In the embodiment illustrated, the source of the images is a filmstrip contained in a film cartridge having a cartridge ID number. The icon 50 includes an origination (source) identification 60 (ID) for identifying the source of the images. In the embodiment illustrated, the origination ID 60 is the film cartridge ID, which contains the film negative from which the images have been made. This information can be obtained by a variety of sources as previously discussed. For example, when a customer order is received by a photofinisher for printing by the photofinisher, the cartridge ID (which represents the origination ID in this case) may be manually entered into the computer controlling scanning and printing, or can be machine read by any appropriate device for reading such number. Thus, the information relating to the origination of the images may be obtained in any manner desired.

In each of the silhouettes 55,56,57,58,59 there is provided an image ID 61. In the embodiment illustrated, the image ID 61 identifies the location of the image on the source, which in the present embodiment is a filmstrip provided within the film cartridge. In the embodiment illustrated, the numeral represents the frame number on the filmstrip and the letters represent the format of the image; PAN represents a Panoramic format, CLS represents a classic format, and HD represents a portrait format. Thus, each of the images can be quickly related to a location on the filmstrip contained within a particular film cartridge from which the images originated and its current format. It is, of course, to be understood that any other identification location system may be provided as desired having any desired number of formats.

Referring to FIG. 2, there is illustrated the second side 14, which has two icons 64,65, each having silhouettes of the images provided on the page. However, since some of the images originated from different sources, each of the icons are associated with a different source. Thus, icon 64 provides a cartridge ID 68 from which the images 21,24 originated, whereas icon 66 includes a cartridge ID 70 from which images 22,23,25 originated. In the particular embodiment illustrated, it can be seen that different icons are provided for identifying different sources. It is, of course, to be understood that various other systems may be utilized for identifying different sources for each of the images. For example, the cartridge ID could be somehow provided in each of the image silhouettes, which correspond to the images on that side of the album leaf.

As previously noted, there are provided a plurality of holes 28 in the margin area 29, which can allow the placement of the album leaf in a loose-leaf binder allowing the individual album leaves to be inserted or removed as desired. It is understood that any other type binder or holder may be used for holding the leaves through the holes 28 or any other binding system may be utilized for holding the leaves.

Figure 4:
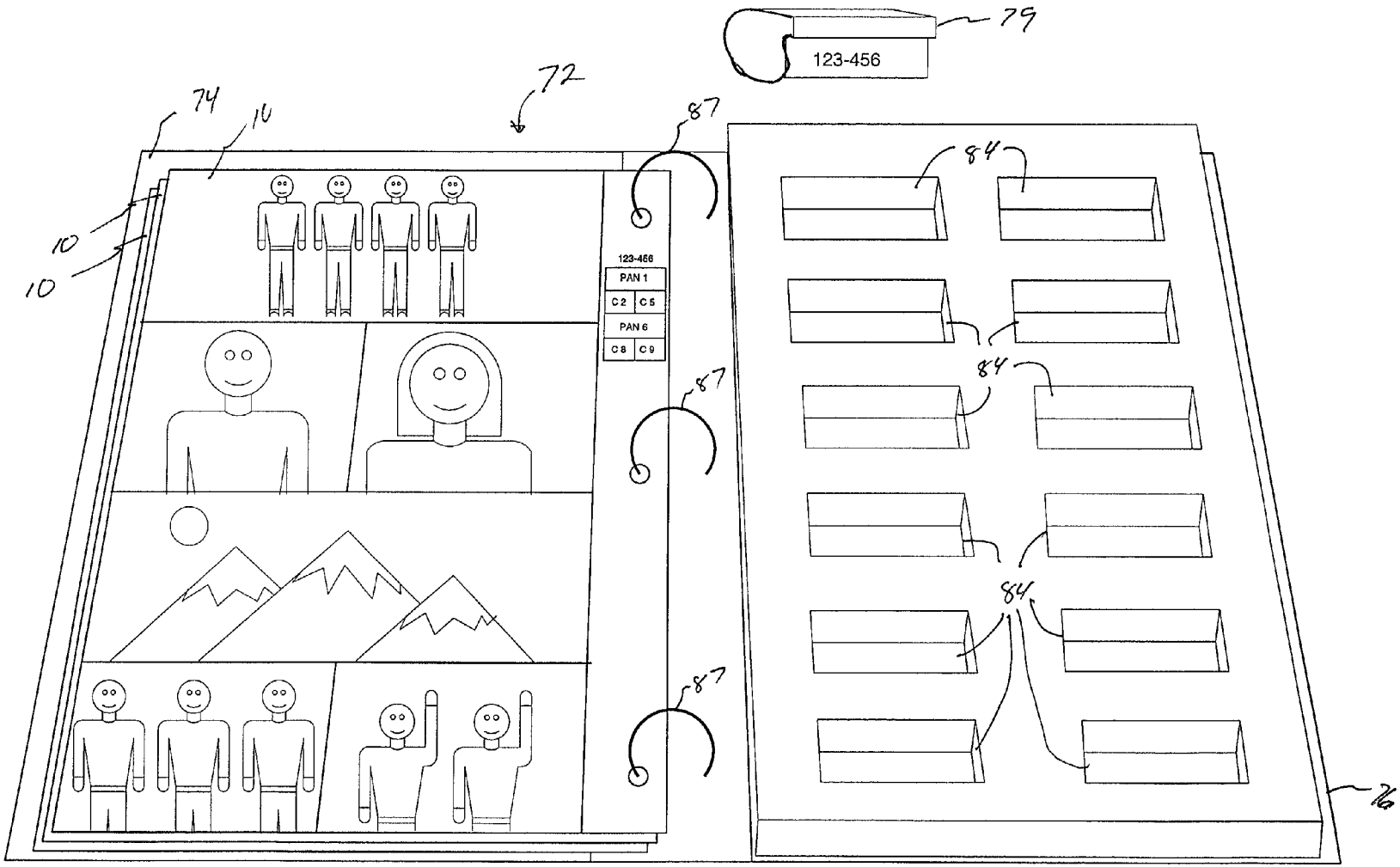
FIG. 4 is a perspective view of a photographic album containing a plurality of album leaves made in accordance with the present invention.

Referring to FIG. 4, there is illustrated a loose-leaf notebook 72 containing a front cover 74 and a back cover 76 having a plurality of rings 87 for holding of the album containing a plurality of album leaves 10. The rings pass through holes 28 provided in the leaves 10. The back cover 76 contains means for holding a plurality of film cartridges 79, each containing a filmstrip of the images provided in the leaves. In the particular embodiment illustrated, the back cover 76 is provided with a plurality of pockets 84, each designed to hold an individual film cartridge such that the cartridge ID provided on the cartridge will be visible when that portion of the loose-leaf binder is revealed. Thus, if an individual is viewing the images on the album leaves and is interested in finding the original source reproduction, or for any other purpose, the individual simply opens up to the back and quickly locates the cartridge containing the image of interest.

It is, of course, understood that the cartridges are not required to be held in the magazine, but may be provided in a separate container wherein the cartridge IDs may be exposed or somehow otherwise written on a label placed on the back of the container.

Figure 5:
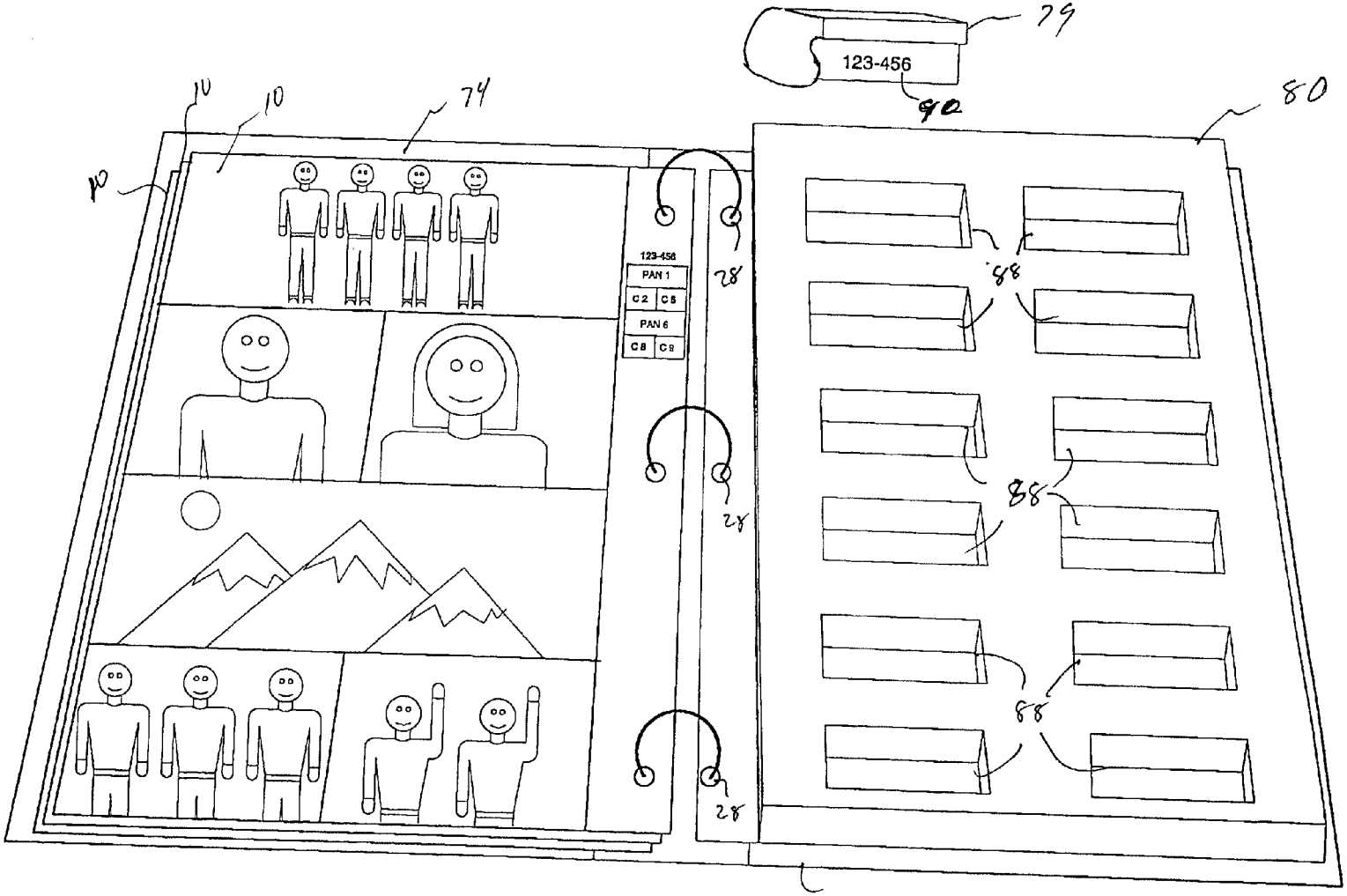
FIG. 5 is a perspective view of an album leaf for holding a plurality of film cartridges, each containing a strip of photographic film.

Referring to FIG. 5, there is illustrated a leaf 80 in notebook 72, identical numerals representing like parts previously discussed, for holding a plurality of film cartridges 79 that may be placed within the notebook 72. The leaf 80 includes a plurality of holes 28, which align with the appropriate rings 78 in the binder 72 and is further provided with a plurality of pockets, each designed to receive a film cartridge. Preferably, the pockets 88 are designed such that the film cartridges 79 may be snapped in and snapped out as desired. This allows the owner of the album to either place the cartridges directly with the images, or if so desired, place them in a separate or different location from the images. Preferably, as illustrated, the pockets 88 are designed so that the cartridge ID 90 would be visible.

It is to be understood that the retaining means for holding the cartridges may be in any appropriate manner in the leaf or binder, for example, but not by way of limitation, snaps, use of Velcro™, or any other securing means that allows securing and removing of the film cartridge that is currently available, or may become available.

While the image-bearing media in the preferred embodiment illustrated is photographic media, the present invention is not so limited, for example, but not by way of limitation, images formed by laser printers and digital thermal printers can be used to print the images on the image-bearing media.

In the particular embodiment illustrated, the source of the image was a filmstrip contained in a film cartridge, however, the present invention is not so limited. For example, but not by way of limitation, the source of the image may be a photo CD, computer disc, or transmitted from a digital memory source such as PC or other digital memory device. Appropriate source ID may be provided for each of the foregoing sources.

The invention has been described in detail with particular reference to certain preferred embodiments thereof, but it will be understood that variations and modifications can be effected within the scope of the invention.

PARTS LIST

10 Album leaf
12 First side
14 Second side
15 Image
16 Image
17 Image
18 Image
19 Image
21 Image
22 Image
23 Image
24 Image
25 Image
28 Holes
29 Margin area
30 Sheet
32 Image forming side
33 Emulsion layer
34 Backside
36 First image retaining section
38 Second image retaining section
40 Fold line
42 Lateral edge portion
43 Space
44 Lateral edge portion
50 Icon
52 Icon
54 Icon

55 Silhouettes
56 Silhouettes
57 Silhouettes
58 Silhouettes
59 Silhouettes
60 Origination identification
61 Image ID
64 Icon
65 Icon
66 Icon
68 Cartridge ID
70 Cartridge ID
72 Loose-leaf notebook
74 Front cover
76 Back cover
78 Rings
79 Film cartridges
80 Leaf
84 Pockets
87 Rings
88 Pockets
90 Cartridge ID

What is claimed is:

1. An album leaf having a first side having a first image retaining section and a second side having a second image retaining section, said first image retaining section on said first side having a plurality of images originating from more than one source and a first icon integrally formed thereon associated with at least one of said plurality of images, said first icon having a first unique ID for identifying a first source which at least one of said plurality of images originated and having a physical format for identifying at least one of said plurality images that the first unique ID is associated, said album leaf having a margin area separated from said plurality of images and said icon being placed in said margin area.

2. An album leaf according to claim 1 wherein said physical format comprises a silhouette of said plurality of images provided on said first side and an image ID.

3. An album leaf according to claim 2 wherein said margin area further includes a plurality of openings for allowing the album leaf to be placed into a binder.

4. An album leaf according to claim 3 wherein said binder is a ring binder.

5. An album leaf according to claim 1 further comprises a second icon integrally formed thereon associated with at least of said plurality images, said second icon having a second unique ID for identifying a second source which said at least one of said plurality images originated and having a physical format for identifying said images that are associated with said second unique ID.

6. An album leaf according to claim 1 wherein said second image retaining section of said second side is also provided with a plurality of images and a third icon having a third unique ID for identifying a third source which at least one of said plurality of images originated and having a physical format for identifying said plurality images that are associated with said third unique ID.

7. An album leaf according to claim 1 wherein said source comprises a film cartridge containing a strip of photographic film, said cartridge having an ID.

8. An album leaf according to claim 1 wherein said source comprises a CD having an ID thereon.

9. An album leaf according to claim 1 wherein said source comprises a computer disc having an ID thereon.

10. An album leaf according to claim 1 wherein said source is a memory storage device.

11. An album leaf according to claim 1 wherein said leaf is made of a photographic paper.

12. A system for displaying, storing and retrieving images, comprising:

an album leaf having a first side having a first image retaining section and a second side having a second image retaining section, said first image retaining section on said first side having a plurality of images originating from more than one source and a first icon integrally formed thereon associated with at least one of said plurality of images, said first icon having a first unique ID for identifying a first source which at least one of said plurality of images originated and having a physical format for identifying at least one of said plurality images that the first unique ID is associated, said album leaf having a margin area separated from said plurality of images and said icon being placed in said margin area; and a binder for containing of said album leaf, said album having a plurality of retaining means for holding items containing the first source of the images contained in said album leaf.

13. A system for displaying, storing and retrieving images according to claim 12 wherein said physical format comprises a silhouette of said plurality of images provided on said first side and an image ID.

14. A system for displaying, storing and retrieving images according to claim 13 wherein said margin area further includes a plurality of openings for allowing the album leaf to be placed into a binder and said retaining means comprises a plurality of pockets.

15. A system according to claim 14 wherein said binder is a ring binder.

16. A system according to claim 12 further comprises a second icon integrally formed thereon associated with at least of said plurality images, said second icon having a second unique ID for identifying a second source which said at least one of said plurality images originated and having a physical format for identifying said images that are associated with said second unique ID.

17. A system according to claim 12 wherein said second image retaining section of said second side is also provided with a plurality of images and a third icon having a third unique ID for identifying a third source which at least one of said plurality of images originated and having a physical format for identifying said plurality images that are associated with said third unique ID.

18. A system for displaying, storing and retrieving images according to claim 12 wherein said first source comprises a film cartridge containing a strip of photographic film, said cartridge having an ID.

19. A system for displaying, storing and retrieving images according to claim 12 wherein said source comprises a CD having an ID thereon.

20. A system for displaying, storing and retrieving images according to claim 12 wherein ad source comprises a computer disc having an ID thereon.

21. A system for displaying, storing and retrieving images according to claim 12 wherein said source is memory storage device.

22. An album leaf according to claim 12 wherein said leaf is made of a photographic paper.

23. A system for displaying, storing and retrieving images, comprising:

an album leaf having a first side having a first image retaining section and a second side having a second image retaining section, said first image retaining section on said first side having a plurality of images originating from more than one source and an icon integrally formed thereon associated with at least one of said plurality of images, said icon having a first unique ID for identifying a first source which at least one of said plurality of images originated and having a physical format for identifying at least one of said plurality images that the first unique ID is associated, said album leaf having a margin area separated from said plurality of images and said icon being placed in said margin area;

a binder for containing said album leaf; and a retaining album leaf having a plurality of retaining means for holding items containing the first source of the images contained in said album leaf.

24. A system for displaying, storing and retrieving images according to claim 23 wherein said physical format comprises a silhouette of said plurality of images provided on said first image retaining section of said first side and an image ID.

25. A system for displaying, storing and retrieving images according to claim 24 wherein said margin area further includes a plurality of openings for allowing the album leaf to be placed into a ring binder.

26. A system for displaying, storing and retrieving images according to claim 23 further comprises a second icon integrally formed thereon associated with at least of said plurality images, said second icon having a second unique ID for identifying a second source which said at least one of said plurality images originated and having a physical format for identifying said images that are associated with said second unique ID.

27. A system for displaying, storing and retrieving images according to claim 23 wherein a third icon is provided on said first image retaining section of said first side having a third unique ID for identifying a third source which at least one of said plurality of images originated and having a physical format for identifying said plurality images that are associated with said third unique ID.

28. A system for displaying, storing and retrieving images according to claim 23 wherein said source comprises a film cartridge containing a strip of photographic film, said cartridge having an ID.

29. A system for displaying, storing and retrieving images according to claim 23 wherein said source comprises a CD having an ID thereon.

30. A system for displaying, storing and retrieving images according to claim 23 wherein said source comprises a computer disc having an ID thereon.

31. A system for displaying, storing and retrieving images according to claim 23 wherein said source is memory storage device.

32. A source retaining album leaf for placement in a binder having at least one album leaf placed therein, said album leave having a first side having a first image retaining section and a second side having a second image retaining section, said first image retaining section on said first side having a plurality of images originating from more than one source and a first icon integrally formed thereon associated with at least one image of said plurality of images, said first icon having a first unique ID for identifying a first source which at least one of said plurality of images originated and having a physical format for identifying at least one of said plurality images that the first unique ID is associated said album leaf having a margin area separated from said plurality of images and said icon being placed in said margin area.

33. A source retaining album leaf according to claim 32 wherein said retaining means comprises a plurality of pockets.

34. An image-bearing media having a first side having a first image retaining section said first image retaining section on said first side having a plurality of images originating from more than one source and a first icon integrally formed thereon associated with at least one image of said plurality of images, said first icon having a first unique ID for identifying a first source which at least one of said plurality of images originated and having a physical format for identifying at least one of said plurality images that the first unique ID is associated said album leaf having a margin area separated from said plurality of images and said icon being placed in said margin area.

35. An image-bearing media according to claim 34 wherein said physical format comprises a silhouette of said plurality of images provided on said first side and an image ID.

36. An image-bearing media according to claim 35 wherein said margin area further includes a plurality of openings for allowing the album leaf to be placed into a binder.

37. An image-bearing media according to claim 36 wherein said binder is a ring binder.

38. An image-bearing media according to claim 34 further comprises a second icon integrally formed thereon associated with at least of said plurality images, said second icon having a second unique ID for identifying a second source which said at least one of said plurality images originated and having a physical format for identifying said images that are associated with said second unique ID.

39. An image-bearing media according to claim 34 wherein said second image retaining section of said second side is also provided with at least one image and a third icon having a third unique ID for identifying a third source which at least one of said plurality of images originated and having a physical format for identifying said plurality images that are associated with said third unique ID.

40. An image-bearing media according to claim 34 wherein said first source comprises a film cartridge containing a strip of photographic film, said cartridge having an ID thereon.

41. An image-bearing media according to claim 34 wherein said source comprises a CD having an ID thereon.

42. An image-bearing media according to claim 34 wherein said source comprises a computer disc having an ID thereon.

43. An image-bearing media according to claim 1 wherein said source is memory storage device.

44. An image-bearing media according to claim 1 wherein said leaf is made of a photographic paper.

45. A system for displaying, storing and retrieving images, comprising:

an image-bearing media having a first side having a first image retaining section and a second side having a second image retaining section, said image retaining section on said first side having a plurality of images formed on said first side originating from a plurality of different sources and an icon also integrally formed on said first side for uniquely having a first unique ID for identifying a first source which at least one of said plurality of images originated and having a physical format for identifying at least one of said plurality images that the first unique ID is associated, said album leaf having a margin area separated from said plurality of images and said icon being placed in said margin area; and a binder for containing said album leaf, said album having a plurality of retaining means for holding items containing the first source of the images contained in said album leaf.

46. A system for displaying, storing and retrieving images according to claim 45 wherein said physical format comprises a silhouette of said plurality of images provided on said first image retaining section of said first side and an image ID.

47. A system for displaying, storing and retrieving images according to claim 46 wherein said album leaf is provided with a margin area separated from said images, said icon being located in said margin area.

48. A system according claim 47 wherein said binder is a ring binder.

49. A system according to claim 45 further comprises a second icon integrally formed thereon associated with at least of said plurality images, said second icon having a second unique ID for identifying a second source which said at least one of said plurality images originated and having a physical format for identifying said images that are associated with said second unique ID.

50. A system according to claim 45 wherein said second image retaining section of said second side is also provided with a plurality of images and a third having a third unique ID for identifying a third source which at least one of said plurality of images originated and having a physical format for identifying said plurality images that are associated with said third unique ID.

51. A system for displaying, storing and retrieving images according to claim 45 wherein said first source comprises a film cartridge containing a strip of photographic film, said cartridge having an ID.

52. A system for displaying, storing and retrieving images according to claim 45 wherein said first source comprises a CD having an ID thereon.

53. A system for displaying, storing and retrieving images according to claim 45 wherein said first source comprises a computer disc having an ID thereon.

54. A system for displaying, storing and retrieving images according to claim 45 wherein said first source is memory storage device.

55. A system according to claim 45 wherein said image-bearing media is made of a photographic paper.

* * * * *

UNITED STATES PATENT AND TRADEMARK OFFICE

CERTIFICATE OF CORRECTION

PATENT NO. : 7,517,168 B1
APPLICATION NO. : 09/213169
DATED : April 14, 2009
INVENTOR(S) : John R. Fredlund et al.

It is certified that error appears in the above-identified patent and that said Letters Patent is hereby corrected as shown below:

| | |
|---|---|
| Column 8, line 56 | delete "ad" and insert --said--. |
| Column 9, line 52 | delete "leave" and insert --leaf--. |
| Column 11, line 7 | after "according" insert --to--. |

Signed and Sealed this

Twenty-fifth Day of August, 2009

David J. Kappos

David J. Kappos
*Director of the United States Patent and Trademark Office*